United States Patent [19]

Bold

[11] 4,117,973

[45] Oct. 3, 1978

[54] CALCULATING DEVICES

[76] Inventor: Eugene W. Bold, 51 Saint Andrews Rd., Severna Park, Md. 21146

[21] Appl. No.: 702,711

[22] Filed: Jul. 6, 1976

[51] Int. Cl.[2] ..... G06G 1/14

[52] U.S. Cl. ..... 235/61 B

[58] Field of Search ..... 235/61 B, 61 NV, 61 GM, 235/61 G, 61 P

[56] References Cited

U.S. PATENT DOCUMENTS

| | | | |
|---|---|---|---|
| 2,225,905 | 12/1940 | Clement | 235/61 B |
| 2,300,401 | 11/1942 | Basler et al. | 235/61 B |
| 2,309,675 | 2/1943 | Schlomann et al. | 235/61 B |
| 2,666,577 | 1/1954 | Parker | 235/61 B |
| 3,078,036 | 2/1963 | Case | 235/61 B |

*Primary Examiner*—Stephen J. Tomsky

[57] ABSTRACT

This invention relates generally to graphic calculating methods and apparatuses, and in particular to an apparatus by which the values and other factors pertaining to bonds, stocks and other securities may be calculated when certain values and other factors are known.

Heretofore, it has been customary to calculate certain values or factors of bonds and the like, given or knowing other values or factors, by mathematical computation according to certain formulas or by the use of certain tables. These methods have, of course, been accurate and have proved to be satisfactory except that in carrying them out, it has been necessary to do considerable work and up to now they have not incorporated all significant values or factors. The primary object of the present invention is to provide a simple device by the use of which certain values or factors of bonds and the like may be quickly ascertained without mathematical computation and, if they were available, without the use of tables.

3 Claims, 3 Drawing Figures

CALCULATING DEVICES

REFERENCE

1. Mavis, F. T.; *The Construction of Nomographic Charts;* International Textbook Company; Scranton, Pennsylvania; 1939.

BACKGROUND

For sake of facility in explaining the invention, reference will be had in the following description thereof to a device designed especially for use in connection with bonds and stocks, but it is to be expressly understood that the invention is not thus limited in scope or by the particular device described, it being applicable in its broad principles to many other uses, as will be readily understood by those versed in the art.

The usual question that confronts a prospective buyer of a bond is, what the yield — net return per period, or yield-to-maturity — of the bond will be, if purchased at a specified price, and interest or a dividend is paid thereon at the face or coupon rate until maturity (or at any specified time if the value of the bond is known or projected for that time), at which time the bond will be paid at its face or maturity value. (The net return per period or yield-to-maturity is that equivalent rate per period earned on the invested amount which will produce the same total net return as the bond or other security in question).

The manner in which the above desribed factors cooperate to govern the yield rate of a bond is expressed mathematically by the following well known and generally accepted equation:

$$P(1+i)^n = C((1+i)^n - 1)/i + M \qquad (1)$$

where:

$P$ = purchase or market price of the bond;

$C$ = coupon rate or face interest rate of the bond for the period between coupon payment dates;

$n$ = number of coupon payment periods from date of purchase to date of maturity;

$i$ = net yield rate or yield-to-maturity of the bond if held to maturity or for $n$ periods; and $M$ = maturity value or value after $n$ periods of the bond.

The price, therefore, which should be paid for a bond in order to realize a given yield, may be calculated using equation (1). The results of such calculation for certain values of the quantities, within a limited range, have been listed in so-called bond basic books or tables in which the prices, calculated to many decimal places, for different half-year maturities, are listed opposite given yields.

However, the large number of cases which arise in practice are concerned with a reverse operation, namely, determining what the yield will be if the bond is bought at a given market price. Equation (1), however, cannot be readily solved for $i$, since this variable can be found only by successive approximations (except when the value of $n$ is small or equals infinity) from the following equation, or equivalent representation, derived from equation (1):

$$i = (C((1+i)^n - 1) + iM)/P(1+i)^n. \qquad C2)$$

In this formula $i$ is not only present on both sides, but occurs raised to the $n^{th}$ power, and since the value of $n$ is often very large, according to the number of periods until maturity, this formula is incapable of direct, rapid and accurate solution (except for a few special values of $n$, or by using sophisticated and expensive electronic computers).

It has, consequently, been customary heretofore to use tables covering many hundreds of pages, calculated in accordance with equation (1), with $M = 100$. These tables in most cases are used inversely in order to ascertain the yield corresponding to any given market price. However, it would seldom occur that there was listed in the table either the given market price (these prices having been calculated for certain given yields as above described) or the given maturity (since only multiples of half-yearly maturities are shown). It was necessary, therefore, to go through a process of calculation or interpolation to determine the actual yield. These tables, therefore, to be capable of results which are accurate usually require the expenditure of considerable effort and time.

The tables and charts used heretofore have failed to take into account two most significant factors: income tax and capital gains tax. There are many kinds of bonds and investments the returns on which are taxed in different ways making it impossible to use one set of tables or charts which do not consider taxes to cover all the different situations. For example, E-Bonds have no coupon rate but have a maturity value with the return (maturity value minus purchase price) being subject to federal but not state and local income taxes; a Treasury Note or Bond if purchased at a discount will have a return due to the coupon rate which is subject to federal but not state and local income taxes and a capital return (maturity value minus purchase price) which is subject to federal, state and local capital gains tax; certain types of municipal bonds have a coupon return which is subject to no federal income tax and, sometimes, no state or local income tax but the capital return is subject to capital gains tax; corporate bonds are generally subject to both income tax on the coupon return and capital gains tax on the capital return.

The present invention has for one of its objects a device whereby an accurate solution of a problem of the above-described nature may be speedily obtained. The only other means of obtaining accurate solutions is by using sophisticated and expensive electronic computers. The device is so constructed, in fact, that any one of the factors involved may be quickly ascertained if the remaining thereof are known.

By setting $t$ = income tax rate, $g$ = capital gains tax rate, and using equation (1), the following equation, which will be readily understood by those versed in the art, can be developed:

$$P(1+(1-t)i)^n = (1-t)C((1+(1-t)i)^n-1)/(1-t)i + (1-g)(M-P) + P. \qquad (3)$$

Note that if $i$ is the actual return rate, then $(1-t)i$ is the after-tax return; if $C$ is the stated coupon rate, then $(1-t)C$ is the after-tax return; and if $(M-P)$ is the actual capital return, then $(1-g)(M-P)$ is the after-tax return. Also note that when $t=0$ and $g=0$ (i.e., there are no taxes), then equation (3) is identical with equation (1).

By setting $T = 1 - t$, $G = 1 - g$, and $I = Ti$ equation (3) can be expressed as $$P(1+I)^n = TC((1+I)^n - 1)/I + G(M-P) + P \quad (4)$$

where I is the after-tax yield rate and the other variables are as defined above.

ADDITIONAL MATHEMATICAL BACKGROUND

Continuing with the background for the invention, equation (4), and consequently equation (1), can be written in a more general form as:

$$P(1+I)^n = TC((1+r)^n - 1)/r + G(M-P) + P \quad (5)$$

where $r$ = assumed rate, which may be different from I, at which TC may be reinvested. The variable $r$ introduced in (5) removes another restriction heretofore found in the development of nomographs, tables and computer programs to solve equation (1), namely the assumption that the return on the reinvestment of each coupon or dividend is at the same rate as the yield-to-maturity. It is well known, however, that interest rates vary, sometimes quite widely, over periods of time so that the assumption concerning the reinvestment rate being equal to the yield-to-maturity has been generally accepted in order to facilitate the solution of equation (1). It is clear that the tables or computations based on this assumption cannot be accurate to many decimal places because of the unknown fluctuations of the reinvestment rate. The accuracy of such solutions are thus limited by the nature of the problem rather than by a specific device or method of solution.

In Reference 1, pp 91–94, nomographic charts were developed which were suitable for solving equation (1), but not equations (4) or (5). These charts were derived by writing equation (1) in the form of a determinant such as: (see Reference 1 for details)

$$\begin{vmatrix} .2P/M & 0 & 1 \\ -C/M & 10 & 1 \\ 1/A & 10S(n,i)/A & 1 \end{vmatrix} = 0 \quad (6)$$

where, for simplicity, $$s(n,i) = (1+i)^n,$$

$$S(n,i) = ((1+i)^n - 1)/i, \text{ and}$$

$$A = S(n,i) + 5s(n,i);$$

and where, as those versed in the art of nomography will readily understand, the first column of the determinant gives the y-ordinate and the second column the x-ordinate of a rectangular coordinate system for the various scales. In the charts so developed the relationships (or maturity lines) between $n$ and $i$ (or I), except when $n$ is equal to unity or infinity, are nonlinear, thus making it difficult, among other reasons, if not impossible to construct devices based on these charts. The following discussion shows how this nonlinearity difficulty can be overcome, making it possible to construct a novel device based on linear maturity lines.

Now equation (5), after some rearrangement, can be written in determinant form, as will be readily understood by those skilled in the art of mathematics, as:

$$\begin{vmatrix} P/M & 0 & 1 \\ -CT/M & 1 & 1 \\ G/D & S(n,r)/D & 1 \end{vmatrix} = 0 \quad (7)$$

where, $$D = s(n,I) + S(n,r) + G - 1.$$

The coordinates $(x,y)$ of the maturity lines, as will be clear to those versed in the art of nomography, are given by the relationship:

$$y = x(G/D)/(S(n,r)/D) \text{ or ps}$$
$$y = xG/S(n,r). \quad (8)$$

Now for a fixed G equation (8) represents a family of straight lines through the point (0,0) with slope equal to $G/S(n,r)$, and most importantly, these straight lines are independent of I. For given $n$, whenever $r = I$ the straight line (8) intersects the corresponding nonlinear maturity line of Reference 1 in such a manner that the linear elements may be used in place of the nonlinear elements for that value of I. The linear element is not set to a particular value, rather it is moved, as will be shown in the illustrated embodiment, along a scale of values for $r$, causing the indicated values of $I$ to change accordingly, until the two values of $r$ and $I$ become identical, this common value is then the solution to the types of problems described heretofore. It is this novel process which makes it possible to construct a device consisting of linear components, said device being capable of being used to solve nonlinear types of problems in a direct and quick manner, as opposed to iterative and slow manners.

Further, equation (7) can be transformed by multiplying it by a nonvanishing determinant into a form whereby the various scales and dimensions can be of any desired values and ranges of values, as will readily be understood by those versed in the art of nomography. Thus the invention is not limited to the scales shown in the illustrated embodiment, but is capable of incorporating a wide range of scales appropriate for any application with any desired degree of accuracy.

TAX CONSIDERATIONS

Equation (7) is used as the basis for including tax considerations in the illustrated embodiment of the invention. Equation (7) is not the only form which can be considered, and the scope of the invention is not intended to be limited by this form. The variable T appears only as a multiplier or coefficient of the coupon rate, $C$. Thus as will be clear to those versed in the art, for each $T$, a new variable $C' = CT$ may be defined which has the same function as the original $C$. In the illustrated embodiment of the invention, one scale is shown for C which corresponds to the value of $T = 1$. Other C′ scales could be mounted on a cylinder, for example, said cylinder being rotated to the desired value of T to expose the corresponding C′ scale. Or the original C scale only need be used performing the multiplication by T outside the particular device. An example will make this clear in the discussion of the operation of the illustrated embodiment. The variable $G$, on the other hand, does not appear in such a manner which makes it possible to use a simple substitution of one of the basic scales. However, from the relationship (8), for each value of $G$, a rate scale can be developed for each $n$ and all values of $r$. These scales can be mounted, for example, on a rotatable cylinder (as shown in the illustrated embodiment), or stored in a computer as another example, and the appropriated scale required at any particular time will be available for use. All combinations of tax rates can thus be implemented.

DESCRIPTION OF THE ILLUSTRATED EMBODIMENT

Figure 1:
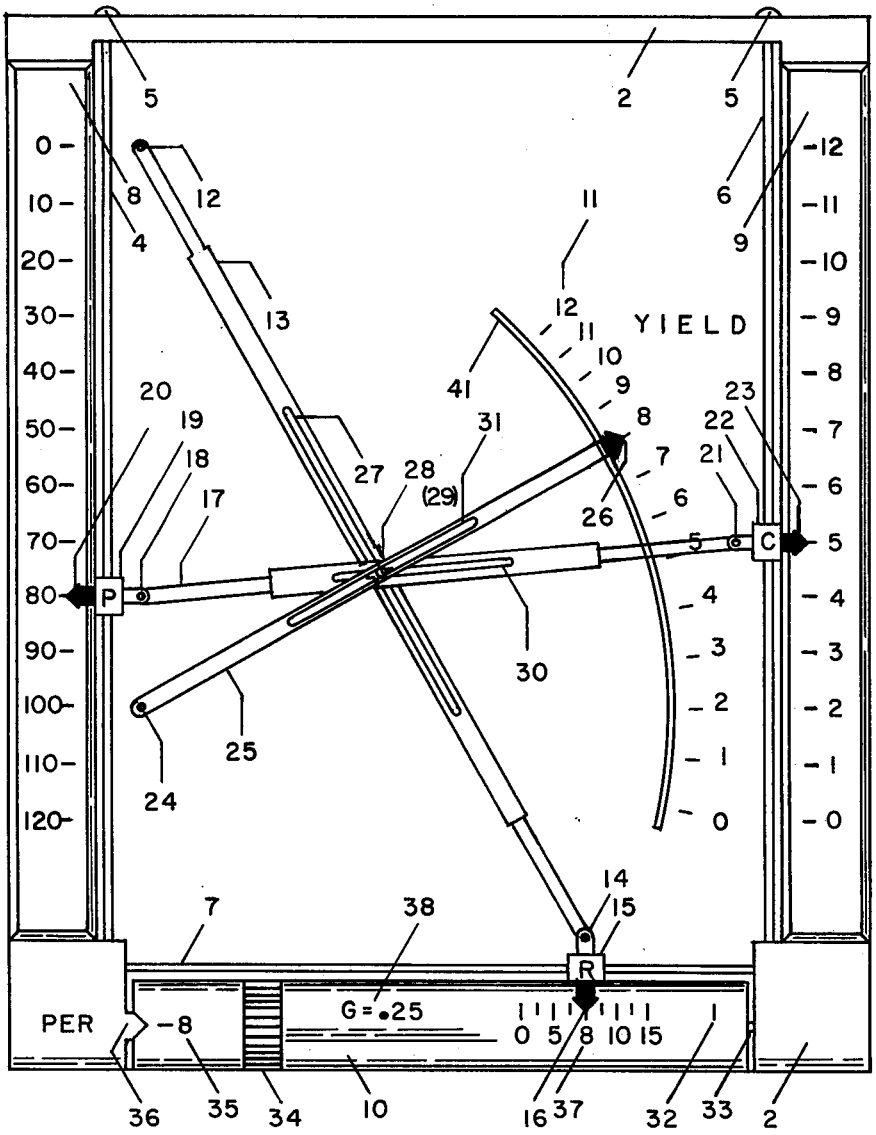
FIG. 1 is a plan view of one embodiment showing the various scales, pointers and arms.
Figure 3:
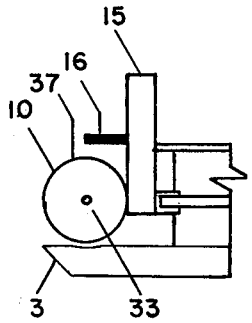
FIG. 3 is a side view showing the disposition of the cylinder holding the Rate scales for various investment periods and capital gain tax rates.
Figure 2:
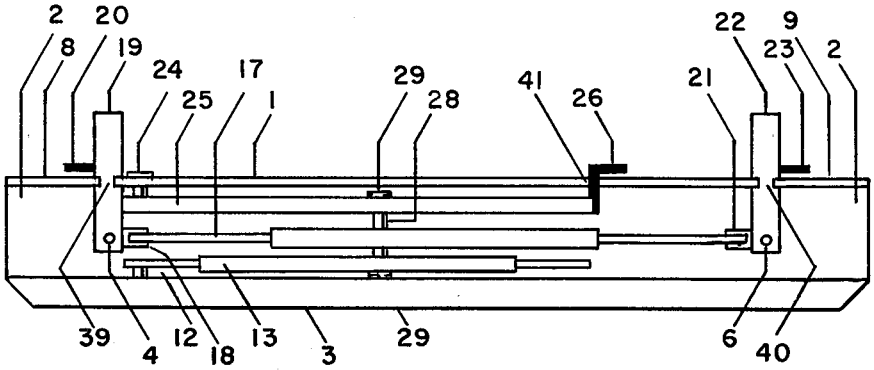
FIG. 2 is an end view showing the depth relationships of the arms. For the sake of clarity details not concerned with these specifics are omitted.

FIG. 1 illustrates a plan view of an embodiment of the invention. Reference number 1 designates a top plate and 3 a basal plate each of suitable size, shape and material here shown as substantially rectangular and preferably comprised of a stiff sheet of plastic or the like which, if desired, may be transparent, as 1 is herein shown in order to facilitate the understanding of the internal operation of this embodiment of the invention. Reference number 2 is a frame of suitable material holding 1 and 3 in proper relationship and holding various other components in place as described hereafter. Reference numbers 4, 6 and 7 are guide rods of suitably stiff material which are attached to frame member 2 by clamps, reference number 5, or other means. Reference numbers 4 and 6 are parallel to each other and perpendicular to 7. Reference number 8 is a scale of conveniently chosen purchase prices mounted, permanently or replaceably, on top member 1, said scale being parallel and proximate to rod 4 and being constructed according to the first row of determinant (7) as heretofore described. Reference number 9 is a scale of conveniently chosen coupon rates mounted, permanently or replaceably, on top member 1, said scale being parallel and proximate to rod 6 and being constructed according to the second row of determinant (7) as heretofore described. Reference number 10 is a removable cylinder parallel along its longitudinal axis to rod 7, attached to frame 2 by centered axle 33 (said 33 may be spring mounted, for example, to allow removal and replacement), and is rotated by means of knurled knob 34, remaining stationary, for example, by friction otherwise; for a given number of periods until maturity, $n$, indicated by reference number 35 (here equal to '8'), and for a given capital gains tax rate, g, indicated by reference number 38 (here equal to '25%'), a return rate scale indicated by reference number 37 and constructed according to equation (8), is mounted on reference number 10. Only the scale for $n = 8$ and $g = 25\%$ is illustrated. A plurality of scales, however, can be placed on element 10 corresponding to any desired values of $n$ and $g$, and one approximate scale can be displayed as required. The illustrated scales, indicated by reference numbers 8, 9, 11 and 37, can be used to solve many of the types of problems heretofore described, but the invention is not limited to these ranges of values only. Reference number 36 is a pointer mounted on frame 2 to indicate the value of the number of periods to maturity 35. Reference number 11 is an acurate scale constructed using a convenient radius from the pivot element 24, said scale showing the yield-to-maturity; said scale is mounted on top member 1 and being constructed by intersecting the arc having a center at 24 with the ray of lines from 24 to the projection of scale 9 corresponding to zero tax rate ($T=1$) onto a conveniently chosen line parallel to 9 (and thus to rod 6), said line being the same line along which element 21 moves. (Yields are sometimes quoted in different ways, such as, yield per period, annual yield, etc., but these are simple transformations of the scale given and are easily implemented as will be understood by those versed in the art.) Reference number 12 is a pivot element attached to basal plate member 3 and is located at the intersection of a conveniently chosen line parallel and proximate to scale 8 and the line perpendicular to scale 8 at the point corresponding to the scale value zero; reference number 24 is a pivot element attached to top member 1 and is located at the intersection of above said line parallel and proximate to scale 8 and the line perpendicular to scale 8 at the point corresponding to the scale value $M$ (here = 100).

Reference number 13 is an expandable/contractible slotted arm, said slot, reference number 27, having conveniently chosen width running through most of arm 13; said arm being freely pivotable about 12 such that the pivot element 12 lies on the center line of slot 27; the opposite end of arm 13 is movable by means of housing 15 with the motion of pivot element 14 attached to 15, said 14 lying on the center line of slot 27, being along a line parallel and proximate to rod 7; said housing 15 being movable by an external force, otherwise remaining stationary, for example, by friction; said housing 15 having attached to it a pointing mechanism 16 for indicating appropriate values on scale 37. Reference number 17 is an expandable/contractible slotted arm situated at a convenient distance above arm 13, said arm 17 having a slot 30 of identical width of slot 27 running through most of arm 17; one end of arm 17 is attached by pivot element 18 to housing 19, said 18 being on the center line of slot 30 of arm 17, and said housing 19 being movable by an external force along rod 4 and slot 39 of top 1, otherwise remaining stationary; said housing 19 having attached to it a pointing mechanism 20 for indicating appropriate values on scale 8; the opposite end of arm 17 is attached similarly to pivot element 21, said 21 being attached to housing 20 being movable along rod 6 and slot 40; said 20 being attached to pointing mechanism 23 for indicating appropriate values on scale 9. Reference number 25 is a slotted arm situated at a convenient distance above arm 17, said 25 having a slot 31 of identical width of slots 27 and 30, said arm 25 being freely pivotable about the pivot element 24, said 24 lying on the center line of slot 31 of arm 25; the opposite end of arm 25 is attached to a pointing mechanism 26 through slot 41 of top member 1, said 26 indicates values on arcuate scale 11 (said 26 is also capable of being moved or held by an external force, otherwise 26 moves freely). Refrence number 28 is a right circular cylindrical pin or other means of diameter equal to the width of slots 27, 30 and 31; said 28 moving freely within said slots and coordinating the movements of arms 13, 17 and 25 as one or more of said arms are moved so as to cause the indication of the solution to the aforementioned types of problems. Reference number 29 is a cap or other means attached to each end of 28 to maintain 28 perpendicular to arms 13, 17 and 25. Reference number 32 on cylinder 10 indicates the point corresponding to infinite investment periods and is shown here, in addition to its usual role in perpetual bond calculations, to enable the illustration of another use of the invention, namely, the solution to a problem when the maturity value is different from M (= 100).

OPERATION OF ILLUSTRATED EMBODIMENT

Given the following conditions:
Purchase Price (P) = $80.
Coupon Rate (C) = $5. per period
Periods-to-Maturity ($n$) = 8
Income Tax Rate ($t$) = 0%
Capital Gain Tax Rate ($g$) = 25%;
the after-tax Yield-To-Maturity is determined in the following manner:

The Purchase Price Pointer 20 is set to indicate $80 on scale 8, the Coupon Rate Pointer 23 is set to indicate $5 on scale 9, (the sequence of setting these pointers is immaterial), the appropriate Return Rate Scale 37 is set for a Capital Gain Tax Rate of 0.25 (indicated by 38) and a Maturity Time of eight periods (indicated by pointer 36 and value 35), the Return Rate Pointer 16 is moved starting at the value zero, for example, on scale 37 to the right (over increasing values) until the Yield-To-Maturity value indicated on scale 11 by pointer 26 and the value on scale 37 indicated by pointer 16 are equal. This common value of 8 (i.e., 8% per period) is the Yield-To-Maturity for the given conditions.

Note that pointer 16 was not set to any given value, but was moved until the values indicated on 37 and 11 were equal. It can be shown that a common value always exists and, further, if the initial value chosen on 37 is less than the value on 11, pointer 16 is moved to the right to obtain equality, otherwise it is moved to the left.

Now given that the Income Tax Rate is 50%, the Coupon Rate is $10 per period, and the other factors remain the same as in the previous example; the Coupon Rate Pointer 23 is set to 5 (= 0.50×10), and the same result is obtained as before. Thus it is clear that scale 9 could be a single scale (premultiplying the Coupon Rate by the Income Tax Rate), or a multiplicity of scales, one for each Income Tax Rate.

If, for another example, the following are given:
Coupon Rate (C) = $5
Periods-to-Maturity (n) = 8
Income Tax Rate ($t$) = 0%
Capital Gain Tax Rate ($g$) = 25%
Yield-to-Maturity ($I$) = 8%; the Purchase Price ($P$) is determined in the following manner:

The Coupon Rate Pointer 23 is set to indicate $5 on scale 9, the Return Rate Scale 37 is set for a Capital Gain Rate of 0.25 (indicated by 38) and for eight periods (indicated by pointer 36 and value 35), the Return Rate Pointer 16 is set to the value 8 (8%) on scale 37, the Purchase Price Pointer 20 is moved until the Yield-To-Maturity value indicated on scale 11 by pointer 26 indicates a value of 8 (= value indicated by pointer 16), the value indicated by pointer 20 is the desired Purchase Price.

The operations performed to solve for any one of the variables given the remaining variables will now be clear to those versed in the art, as will be the fact that after all but one pointer or scale have been set, the remaining pointer or scale, as the case may be, is moved until the value indicated by pointer 26 on scale 11 is identical to the value indicated by pointer 16 on scale 37.

What is claimed is:

1. A calculating device for calculating bond factors and the like comprising:
a base;
two parallel scales on the base;
an extensible arm the ends of which are movable along said two parallel scales;
a third scale on the base between the said parallel scales;
an extensible arm one end of which is movable along said third scale and the other end pivotable about a point near the first parallel scale;
a fourth scale on the base near the second parallel scale;
an arm one end of which is movable along said fourth scale and the other end pivotable about a point near the first parallel scale;
means for interconnecting the three arms in a point; and
means for permitting free movement of the three arms;
said calculating device being capable, through the process of matching values on the said third and fourth scales, of displaying answers in terms of one variable when all but one variable are given.

2. A calculating device according to claim 1 wherein there are a plurality of scales between the two parallel scales; and
means for displaying one appropriate scale for a given calculation.

3. A calculating device according to claim 1 wherein the first parallel scale is a scale of Purchase Prices for bonds;
the second parallel scale is a scale of Coupon Rates for bonds corresponding to a given income tax rate;
the scale between the two parallel scales is a scale of Return Rates corresponding to a given investment period and capital gains tax rate;
the fourth scale is a scale of Yields-to-Maturity for bonds; and wherein
the two ends of the extensible arm between the two parallel scales are set at a given purchase price and coupon rate, respectively;
the movable end of the extensible pivotable arm is then moved along the Return Rate scale until the value indicated on the Return Rate scale is equal to the value indicated by the end of the other pivotable arm on the Yield-to-Maturity scale;
said common value is the Yield-to-Maturity for the given parameters.

* * * * *